US010266360B2

(12) United States Patent
Ishibashi et al.

(10) Patent No.: US 10,266,360 B2
(45) Date of Patent: Apr. 23, 2019

(54) CONVEYOR DEVICE

(71) Applicant: IHI Corporation, Tokyo (JP)

(72) Inventors: Mareto Ishibashi, Tokyo (JP); Yoshiyuki Wada, Tokyo (JP); Kensuke Hirata, Tokyo (JP); Noriaki Hasegawa, Tokyo (JP)

(73) Assignee: IHI CORPORATION, Tokyo (JP)

( * ) Notice: Subject to any disclaimer, the term of this patent is extended or adjusted under 35 U.S.C. 154(b) by 170 days.

(21) Appl. No.: 15/198,167

(22) Filed: Jun. 30, 2016

(65) Prior Publication Data

US 2016/0304306 A1 Oct. 20, 2016

Related U.S. Application Data

(63) Continuation of application No. PCT/JP2015/064735, filed on May 22, 2015.

(30) Foreign Application Priority Data

May 23, 2014 (JP) ..... 2014-107449

(51) Int. Cl.

| | |
|---|---|
| ***B65H 20/06*** | (2006.01) |
| ***B65H 20/18*** | (2006.01) |
| ***B65H 35/04*** | (2006.01) |
| ***B65H 35/06*** | (2006.01) |
| ***B65H 23/032*** | (2006.01) |
| ***B65H 23/10*** | (2006.01) |

(52) U.S. Cl.

CPC ..... *B65H 20/18* (2013.01); *B65H 20/06* (2013.01); *B65H 23/032* (2013.01); *B65H 23/0326* (2013.01); *B65H 23/10* (2013.01); *B65H 35/04* (2013.01); *B65H 35/06* (2013.01); *B65H 2301/331* (2013.01); *B65H 2301/4422* (2013.01); *B65H 2301/5151* (2013.01); *B65H 2301/51532* (2013.01); *B65H 2406/112* (2013.01); *B65H 2701/132* (2013.01)

(58) Field of Classification Search

CPC ..... B65H 20/00; B65H 20/06; B65H 20/18; B65H 23/0204; B65H 23/0208; B65H 23/032; B65H 23/0326; B65H 23/0328; B65H 20/16; B65H 2301/331

See application file for complete search history.

(56) References Cited

U.S. PATENT DOCUMENTS

| | | | | |
|---|---|---|---|---|
| 3,568,904 A * | 3/1971 | Kurz | ..... | B65H 23/0326 226/15 |
| 6,092,709 A * | 7/2000 | Schoenbeck | ..... | B65H 20/18 226/112 |
| 2017/0001824 A1* | 1/2017 | Schreiber | ..... | B65H 16/106 |

FOREIGN PATENT DOCUMENTS

| | | | |
|---|---|---|---|
| CN | 201140572 | Y | 10/2008 |
| CN | 101439321 | A | 5/2009 |
| CN | 102476754 | A | 5/2012 |
| CN | 202829079 | U | 3/2013 |
| CN | 103010798 | A | 4/2013 |

(Continued)

*Primary Examiner* — Jennifer B Swinney

(74) *Attorney, Agent, or Firm* — Rothwell, Figg, Ernst & Manbeck, P.C.

(57) ABSTRACT

The present disclosure is a conveyor device which feeds a thin workpiece from an unwinding roll and conveys the thin workpiece on a conveyance path. The conveyor device includes first movable holding members, fixed holding members, a cutting device, second movable holding members, a first position sensor, and a first correction mechanism.

2 Claims, 8 Drawing Sheets

(56) References Cited

FOREIGN PATENT DOCUMENTS

| | | | | | |
|---|---|---|---|---|---|
| DE | 2428113 | A1 | * | 1/1976 | ..... B65H 23/0212 |
| DE | 10000262 | A1 | * | 7/2001 | ..... A41H 43/0235 |
| DE | 102011115881 | A1 | * | 4/2013 | ..... B65B 41/14 |
| DE | 102012021920 | A1 | * | 5/2014 | ..... B29C 65/743 |
| EP | 0990612 | A2 | * | 4/2000 | ..... B65H 20/18 |
| FR | 2377661 | A1 | * | 8/1978 | ..... B65H 23/0204 |
| JP | 5-43095 | A | | 2/1993 | |
| JP | 05043095 | A | * | 2/1993 | ..... B65H 23/032 |
| JP | 10-59592 | A | | 3/1998 | |
| JP | 2000-86034 | A | | 3/2000 | |
| JP | 2001-252891 | A | | 9/2001 | |
| JP | 2002-284415 | A | | 10/2002 | |
| JP | 2006-69735 | A | | 3/2006 | |
| JP | 2011-213439 | A | | 10/2011 | |

* cited by examiner

CONVEYOR DEVICE

CROSS-REFERENCE TO RELATED APPLICATIONS

The present application is a continuation application of International Application No. PCT/JP2015/064735 filed May 22, 2015, which claims priority to Japanese Patent Application No. 2014-107449 filed May 23, 2014. The contents of these applications are incorporated herein by reference in their entirety.

TECHNICAL FIELD

The present disclosure relates to a conveyor device.

BACKGROUND

In recent years, for example, an ultra-thin glass or resin sheet with a thickness of 1 mm or less, or the like is used for various products. Generally, when a thin workpiece made of such a glass or resin sheet is fed (unwound) from, for example, an unwinding roll and is cut at a predetermined dimension, the thin workpiece is conveyed (fed) from the unwinding roll by a predetermined length, and the thin workpiece is cut by a cutting device.

It is necessary to prevent contamination due to adhesion of foreign substances, or the like in the case of a thin workpiece with high transparency like the thin workpiece made of the glass or resin sheet. Therefore, when such a thin workpiece is conveyed, in particular, it is preferable to convey a product quality area corresponding to a central portion in a width direction of the thin workpiece in a noncontact manner. Also, in the case of the thin workpiece, not only is simple prevention of contamination required, but also high accuracy is required for a cut dimension in many cases.

However, when the thin workpiece is conveyed in a noncontact manner, the thin workpiece is shifted at the time of unwinding or meandered at the time of conveying so that the thin workpiece is unlikely to be normally disposed with respect to the cutting device when cut by the cutting device. For example, the thin workpiece is obliquely disposed with respect to the cutting device so that the thin workpiece is unlikely to be cut to a desired shape and dimension. Thus, in the related art, when the thin workpiece is conveyed, meandering of the thin workpiece is controlled using, for example, tilting of a turn bar (for example, refer to Patent Document 1).

DOCUMENTS OF THE PRIOR ART

Patent Documents

[Patent Document 1]

Japanese Unexamined Patent Application, First Publication No. 2000-86034

SUMMARY

However, when meandering of a thin workpiece is controlled using tilting of a turn bar as described above, the tilting control of the turn bar is very complicated. Thus, it is difficult to eliminate the meandering of the thin workpiece. In other words, it is difficult to cut the thin workpiece to a high-precision shape and dimension.

The present disclosure was made in view of the above-described circumstances, and an object of the present disclosure is to provide a conveyor device capable of conveying a thin workpiece in a noncontact manner as well as of accurately cutting the thin workpiece at a desired cut shape and cut dimension.

In order to accomplish the above-described objects, in the present disclosure, a conveyor device which feeds a thin workpiece from an unwinding roll and conveys the thin workpiece on a conveyance path includes: a pair of first movable holding members configured to detachably hold tip-side end sections at both sides of the thin workpiece fed on the conveyance path and convey the thin workpiece on the conveyance path; a pair of fixed holding members configured to detachably hold end sections at both sides of a side of the unwinding roll of the thin workpiece fed on the conveyance path; a cutting device configured to cut the thin workpiece in a width direction thereof between the first movable holding members and the fixed holding members; a pair of second movable holding members configured to detachably hold end sections at both sides closer to a tip side of the thin workpiece conveyed by the first movable holding members than the end sections at both sides held by the first movable holding member at the tip side thereof and further convey the thin workpiece on the conveyance path; a first position sensor provided between the unwinding roll and the first movable holding members and configured to detect a position in the width direction of the thin workpiece fed from the unwinding roll; and an unwinding position correction mechanism configured to correct a position of the unwinding roll in a direction perpendicular to an unwinding direction based on a detection result of the first position sensor.

According to the conveyor device of the present disclosure, the unwinding position correction mechanism configured to correct the position of an unwinding roll in a direction perpendicular to an unwinding direction based on a detection result of the first position sensor is provided. Thus, when a thin workpiece is shifted or meandered at the time of the unwinding, and thus the thin workpiece is shifted in a width direction with respect to a preset position, the position shift of the thin workpiece is detected by the first position sensor so that the position shift of the thin workpiece can be corrected by the unwinding position correction mechanism configured to correct the position of the unwinding roll. Therefore, the thin workpiece can be accurately cut by the cutting device at a desired dimension. Also, the tip-side end sections at both sides of the thin workpiece are detachably held by the pair of first movable holding members, and the end sections at both sides closer to the tip side thereof than the end sections at both sides held by the first movable holding members at the tip side of the thin workpiece conveyed by the first movable holding members are detachably held by the pair of second movable holding members. Thus, the thin workpiece can be conveyed in a substantially noncontact manner.

DETAILED DESCRIPTION

Figure 1:
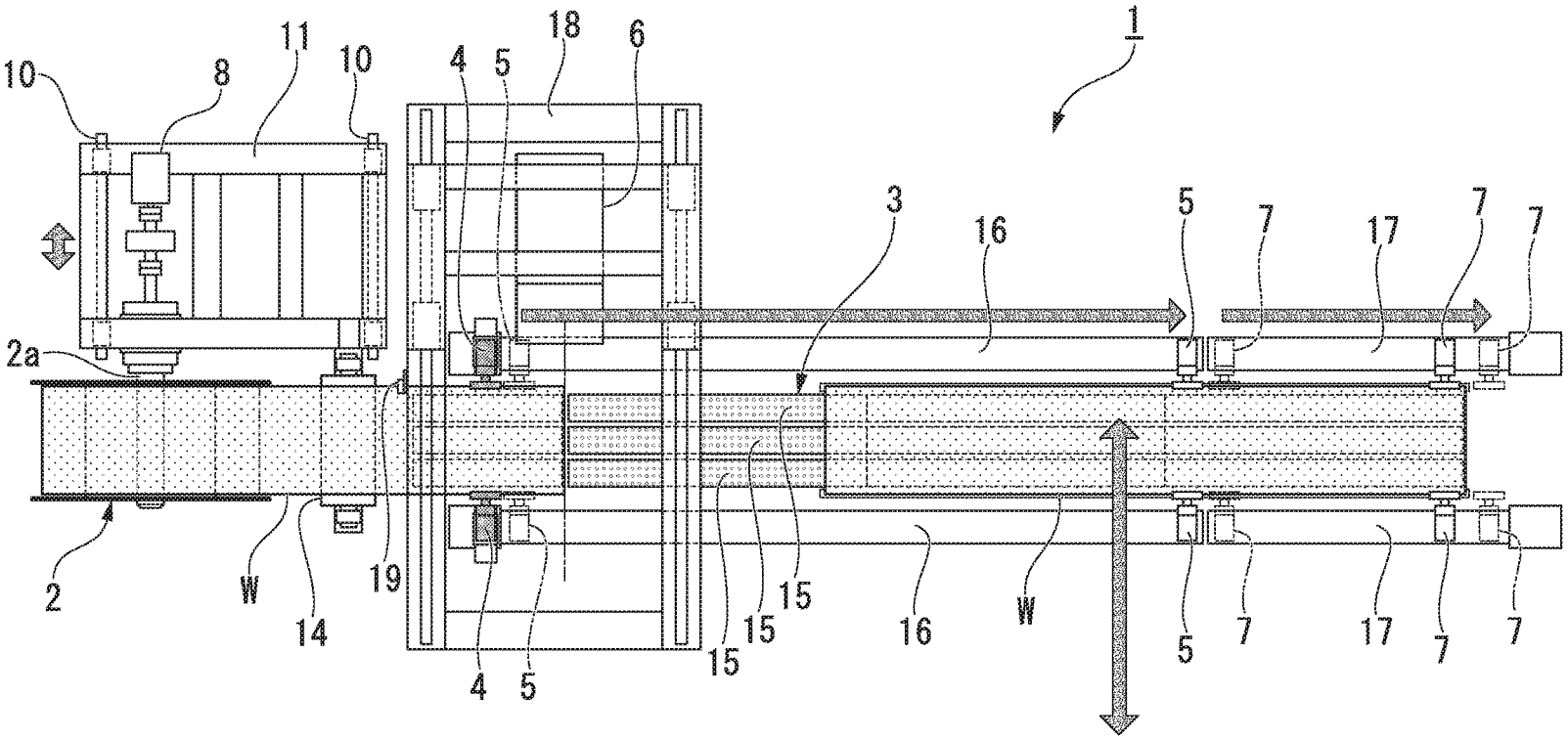
FIG. 1 is a plan view showing a schematic constitution of a first embodiment of a conveyor device related to the present disclosure.
Figure 2:
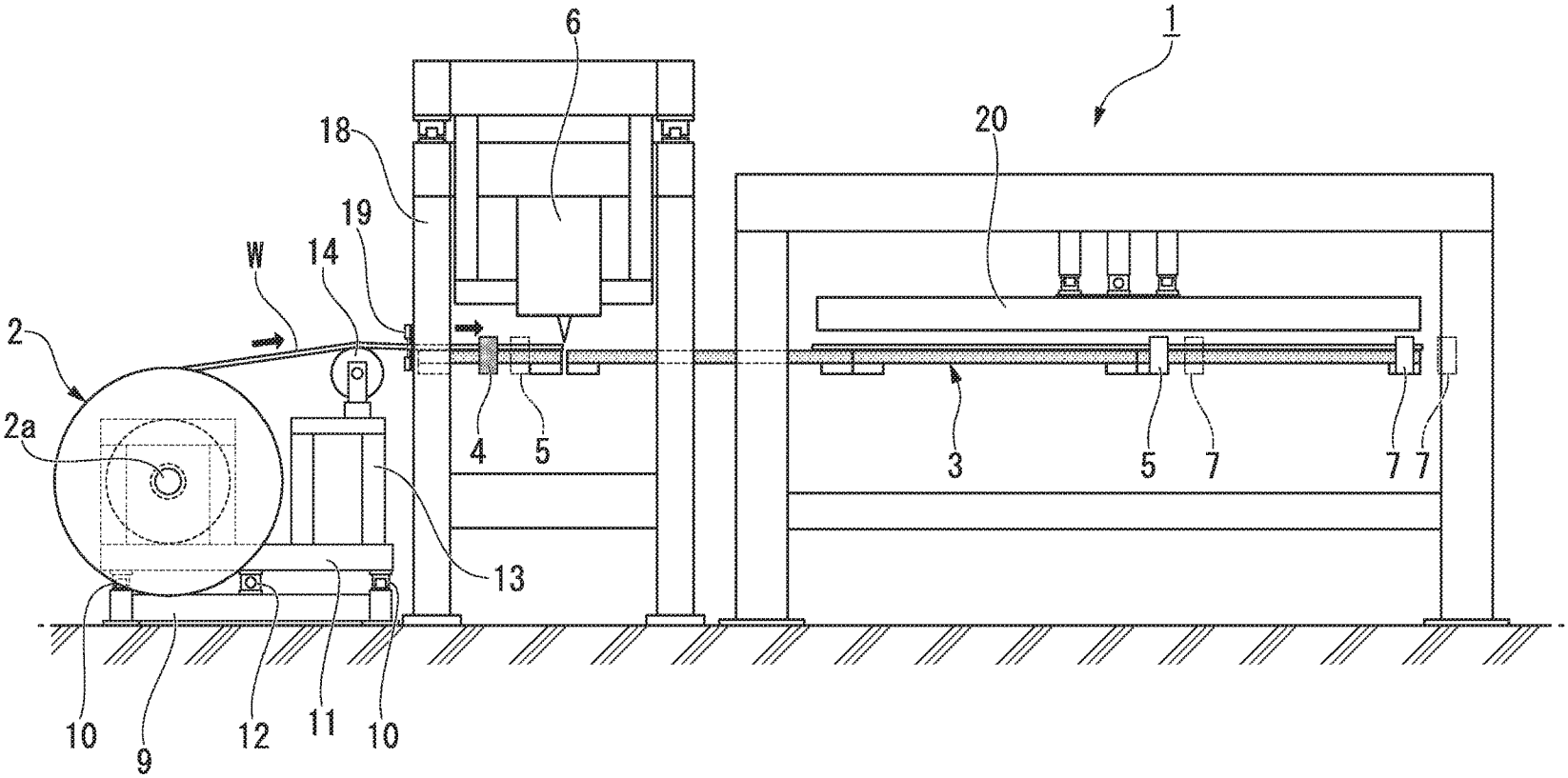
FIG. 2 is a side view showing the schematic constitution of the first embodiment of the conveyor device related to the present disclosure.

Hereinafter, a conveyor device of the present disclosure will be described in detail with reference to the drawings. Note that a scale of each member is appropriately changed to give a distinguishable size to each member in the accompanying drawings. FIG. 1 is a plan view showing a schematic constitution of a first embodiment of a conveyor device related to the present disclosure. FIG. 2 is a side view showing the schematic constitution of the first embodiment of the conveyor device related to the present disclosure. Reference numeral 1 indicates the conveyor device in FIGS. 1 and 2.

The conveyor device 1 is a device configured to convey thin workpieces W which are each made of, for example, an ultra-thin glass or resin sheet with a thickness of 1 mm or less, or the like in a noncontact state. The "noncontact state" described here does not mean that the conveyor device 1 does not fully come into contact with the thin workpiece W but means that the conveyor device 1 does not come into contact with a product quality area of the thin workpiece W. In other words, in the thin workpiece W, generally, a central portion of the thin workpiece W is the product quality area. Thus, it is common to prevent such a product quality area from being directly held. Therefore, in this thin workpiece W, generally, a non-product quality area corresponding to a circumferential section referred to as a "flange" located at an outside of the product quality area, that is, end sections at both sides in a width direction of a width with about 5 mm to 10 mm, is a region which is directly held.

The conveyor device 1 in the embodiment is a device which does not directly hold the product quality area of the thin workpiece W in that way and directly holds only the end sections at both sides in a width direction of the thin workpiece W serving as the non-product quality area and conveys it. In other words, as shown in FIGS. 1 and 2, the conveyor device 1 includes an unwinding roll 2, a conveyance path 3 configured to convey the thin workpiece W fed from the unwinding roll 2, a pair of fixed holding members 4, a pair of first movable holding members 5, a cutting device 6, and a pair of second movable holding members 7.

As shown in FIG. 1, the unwinding roll 2 includes a roll shaft 2*a* which winds the thin workpiece W and a driving source 8, such as a motor, coupled to the roll shaft 2*a* and configured to rotate the roll shaft 2*a*. The driving source 8 is provided with a control unit (not shown) configured to control a rotation speed of the roll shaft 2*a*. The control unit basically controls the rotation speed of the roll shaft 2*a* to be substantially constant and maintains an unwinding speed (a feed speed) of the thin workpiece W unwound from the unwinding roll 2 to be constant. Note that the above-described ultra-thin glass, resin sheet, or the like are used as the thin workpiece W.

As shown in FIG. 2, the unwinding roll 2 and the driving source 8 are movably provided on a fixed base 9 installed at a floor in a direction perpendicular to an unwinding direction of the unwinding roll 2, that is, in a direction along a lengthwise direction of the roll shaft 2*a*. In other words, a pair of linear motion guides 10 are disposed on the fixed base 9 in parallel with the roll shaft 2*a*, and a moving frame 11 is movably attached to the pair of linear motion guides 10. In addition, as shown in FIG. 1, the driving source 8 and the unwinding roll 2 coupled to the driving source 8 are mounted on the moving frame 11. Also, as shown in FIG. 2, an unwinding position correction unit 12 is provided between the pair of linear motion guides 10 and 10 on the fixed base 9.

The unwinding position correction unit 12 is formed by a linear motor mechanism and a ball screw mechanism and accurately reciprocates the moving frame 11 along the pair of linear motion guides 10 and 10. The unwinding position correction unit 12 is provided with a control unit (not shown). The unwinding position correction unit 12 moves the unwinding roll 2 on the moving frame 11 in the direction perpendicular to the unwinding direction based on a detection result of a first position sensor through the control unit as will be described below. Thus, an unwinding position is corrected. In other words, an unwinding position correction mechanism (a first correction mechanism) related to the present disclosure is constituted by the control unit and the unwinding position correction unit 12.

A height adjustment roller 14 is disposed downstream from the unwinding roll 2 on a support table section 13 provided on the moving frame 11. The height adjustment roller 14 is a conveyance roller configured to convey the thin workpiece W unwound from the unwinding roll 2 and has an upper end arranged slightly higher than a conveyance surface of the conveyance path 3. With such a constitution, the height adjustment roller 14 conveys the thin workpiece W unwound from the unwinding roll 2 on the conveyance surface of the conveyance path 3.

The conveyance path 3 is disposed downstream from the height adjustment roller 14, and includes a plurality of elongate plate-like conveyance units 15 arranged and disposed in a conveyance direction of the thin workpiece W as shown in FIG. 1. The conveyance units 15 have a known constitution such as a floating type unit in which an object is floated by discharging air, a free roller conveyor type unit, and a belt conveyor type unit.

In the embodiment, the floating type unit is adopted because it is preferable to convey the product quality area in the noncontact manner not to directly hold the product quality area which is on the central portion in the width direction of the thin workpiece W in particular. In other words, in the free roller conveyor type unit and the belt conveyor type unit, a lower surface of the thin workpiece W is likely to rub against a conveyor (the conveyance path) when the thin workpiece W is moved in the width direction thereof by performing position correction to be described below. The floating type conveyance units 15 include a plurality of air discharging holes (not shown) provided at upper surfaces thereof and an air supply source connected to the air discharging holes through pipes so that a predetermined amount of air is discharged from the air discharging holes. Thus, the thin workpiece W is floated above the upper surfaces of the conveyance units 15 (the conveyance path 3).

As shown in FIG. 1, first clamp rails 16 and second clamp rails 17 are disposed at both sides of the conveyance path 3 in the conveyance direction of the conveyance path 3. Note that, in FIG. 2, the first clamp rails 16 and the second clamp rails 17 are not illustrated. The fixed holding members 4 are provided upstream (a side of the unwinding roll 2) from the first clamp rails 16, and the first movable holding members 5 are provided downstream from the fixed holding members 4.

The fixed holding members 4 are fixed to the first clamp rails 16 via attachment members (not shown). In other words, the fixed holding members 4 are fixed without moving in a lengthwise direction (the conveyance direction of the conveyance path 3) of the first clamp rails 16. Note that the fixed holding members 4 may be fixed to, for example, the conveyance units 15 (the conveyance path 3), or the like via the attachment members (not shown) without being attached to the first clamp rails 16.

Figure 3:
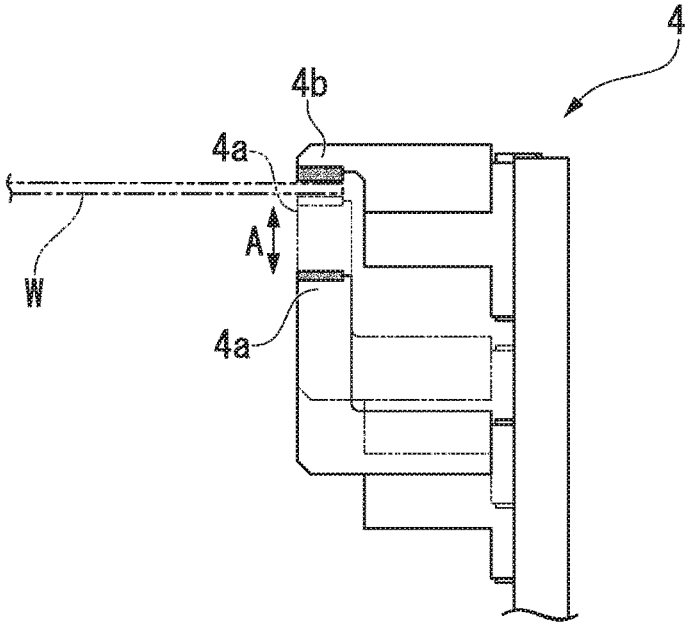
FIG. 3 is a side view for describing a schematic constitution of a fixed holding member.

As shown in FIG. 3, each of the fixed holding members 4 is a general clamp having a lower plate 4*a* and an upper plate 4*b*. The lower plate 4*a* and the upper plate 4*b* are formed to be capable of being connected to and separated from each other as indicated by arrow A of FIG. 3 using an air cylinder (not shown) so that they detachably hold the thin workpiece W. Here, sites holding the thin workpiece W are tips of the lower plate 4*a* and the upper plate 4*b*. Thus, the fixed holding members 4 directly hold only the end sections at both sides serving as the non-product quality area without directly holding the product quality area of the thin workpiece W.

Figure 4:
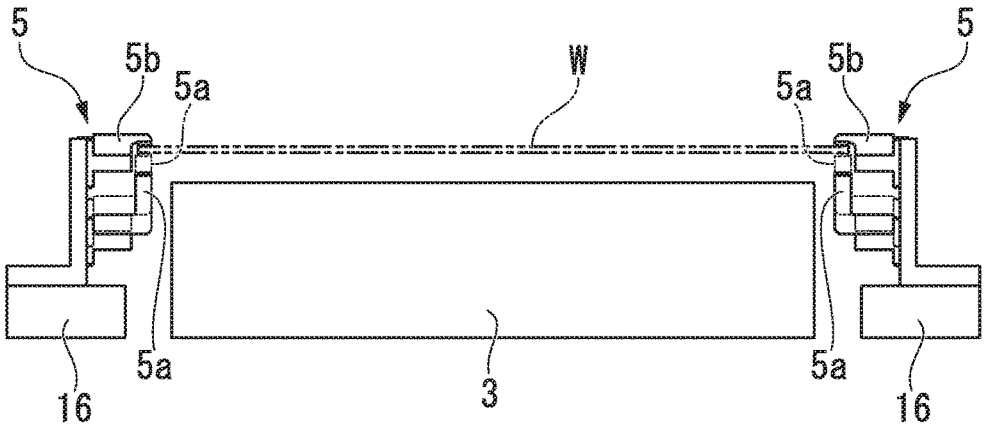
FIG. 4 is a view for describing a schematic constitution of a first movable holding member.

As shown in FIG. 4, each of the first movable holding members 5 is also a general clamp having a lower plate 5*a* and an upper plate 5*b*. The lower plate 5*a* and the upper plate 5*b* are formed to be capable of being connected to and separated from each other like the fixed holding member 4 using an air cylinder (not shown) so that they detachably hold the thin workpiece W. The first movable holding members 5 directly hold only the end sections at both sides serving as the non-product quality area without directly holding the product quality area of the thin workpiece W like the fixed holding members 4.

Also, the pair of first movable holding members 5 are attached to the first clamp rails 16 to be able to reciprocate. In other words, the pair of first movable holding members 5 can reciprocate in the lengthwise direction (the conveyance direction of the conveyance path 3) of the first clamp rails 16. Here, each of the first clamp rails 16 includes, for example, a ball screw mechanism and a linear motor mechanism. Thus, a moving speed and a moving distance of the pair of first movable holding members 5 are accurately controlled.

As shown in FIG. 1, the second clamp rails 17 are provided with the second movable holding members 7. The second movable holding member 7 are constituted like the first movable holding members 5 shown in FIG. 4 and are movably attached to the second clamp rails 17. In other words, the second movable holding members 7 can reciprocate in a lengthwise direction (the conveyance direction of the conveyance path 3) of the second clamp rails 17. Note that the second movable holding members 7 also directly hold only the end sections at both sides serving as the non-product quality area without directly holding the product quality area of the thin workpiece W like the fixed holding members 4 and the first movable holding members 5. Each of the second clamp rails 17 also includes a ball screw mechanism and a linear motor mechanism like the first clamp rails 16. Thus, a moving speed and a moving distance of the second movable holding members 7 are also accurately controlled.

Also, as shown in FIGS. 1 and 2, in the conveyor device 1, a holding frame 18 is provided at a side of the unwinding roll 2 of the conveyance path 3, and the holding frame 18 is provided with the cutting device 6. The cutting device 6 is disposed above the conveyance path 3 downstream from the fixed holding members 4, and vertically and horizontally moves a cutting blade, for example, to cut the thin workpiece W in the width direction thereof. This cutting device 6 is controlled such that the thin workpiece W is conveyed while tip-side end sections at both sides of the thin workpiece W are held by the first movable holding members 5, a position of the unwinding roll 2 is corrected, and the cutting device 6 cuts the thin workpiece W while end sections at both sides of a rear end side (a side of the unwinding roll 2) of the thin workpiece W are held by the fixed holding members 4 as will be described below.

Also, a first position sensor 19 is provided between the unwinding roll 2 and the first movable holding members 5. To be specific, the first position sensor 19 is provided at the holding frame 18 near the height adjustment roller 14 downstream from the height adjustment roller 14. The first position sensor 19 detects a position in the width direction of the thin workpiece W fed from the unwinding roll 2. In the embodiment, the first position sensor 19 detects an edge position of one side of the thin workpiece W and detects a shift amount, that is, a shifted direction and a shift length (a distance) from a preset position.

The first position sensor 19 is connected to the control unit of the unwinding position correction unit 12 constituting the unwinding position correction mechanism and transmits a detected shift amount to the control unit as an electrical signal. With such a constitution, in the unwinding position correction mechanism, the control unit controls the unwinding position correction unit 12 based on the detection result of the first position sensor 19 so that a position of the unwinding roll 2 in a direction perpendicular to the unwinding direction is corrected. In other words, the unwinding position correction mechanism moves the unwinding roll 2 by a length (a distance) which is substantially equal to a length shifted in a direction opposite to a direction in which the thin workpiece W is shifted.

Here, since a position of the first position sensor 19 and a position of the unwinding roll 2 are at different positions in a lengthwise direction of the thin workpiece W, it is preferable to slightly differentiate a shift amount detected by the first position sensor 19 and a correction amount for the unwinding roll 2 in consideration of the difference between the positions. Therefore, such a relationship between the "shift amount" and the "correction amount" is acquired by a pre-calculation, or the like, and the control unit determines a correction amount (a movement amount) of the unwinding roll 2 with respect to the shift amount detected by the first position sensor 19 based on the calculation formula or the like.

As shown in FIG. 2, in the conveyor device 1, a transfer device 20 is disposed above a downstream side of the conveyance path 3. The transfer device 20 absorptively-holds each cut thin workpiece W conveyed downstream from the conveyance path 3 by the second movable holding members 7, transfers the thin workpiece W to a storage section (not shown) disposed in the vicinity (for example, a lateral side) of the conveyance path 3, and detaches the thin workpiece W and displaces and stores it in the storage section as will be described below.

Figure 5:
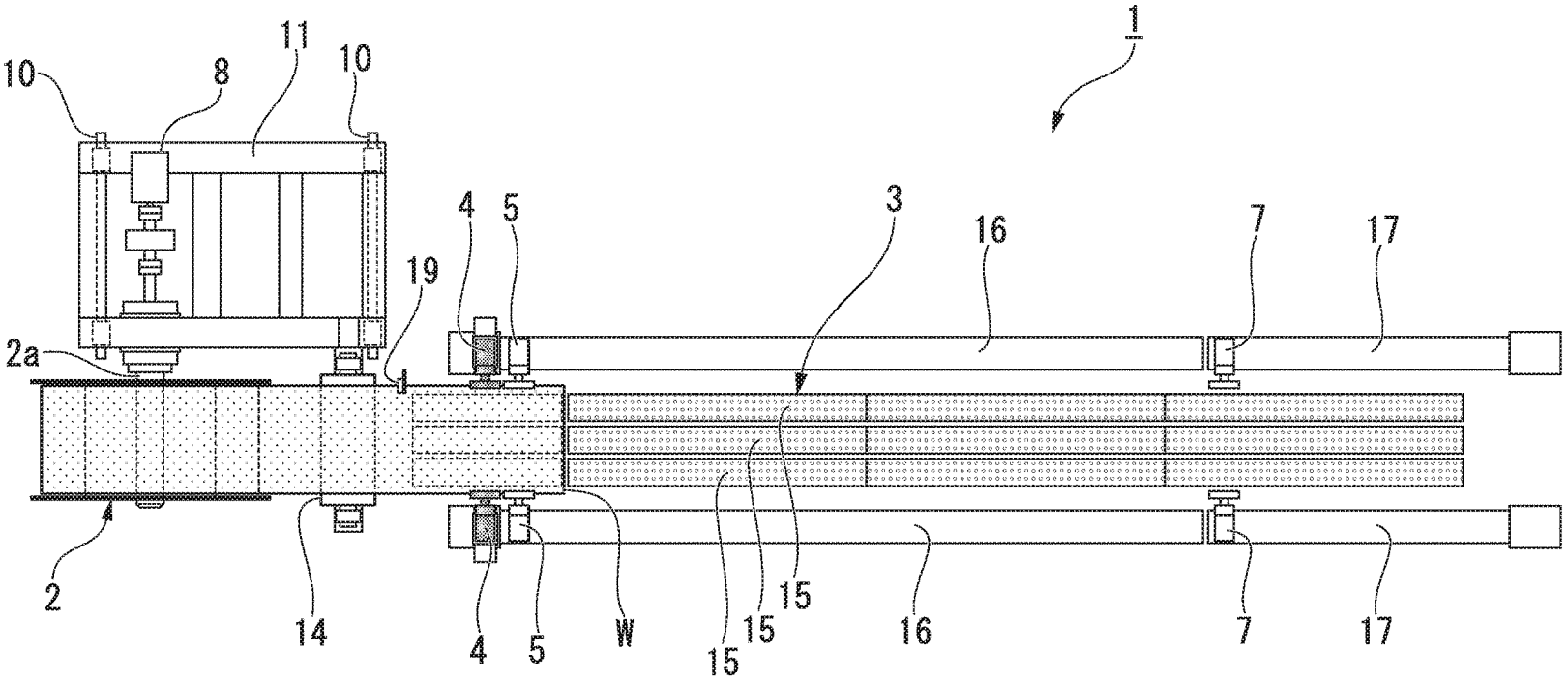
FIG. 5 is a plan view for describing an operation of the conveyor device shown in FIG. 1.

Next, an operation of the conveyor device 1 with such a constitution will be described. As shown in FIG. 5, a thin workpiece W is first fed (unwound) from the unwinding roll 2, and tip-side end sections at both sides of the thin workpiece W are held by the first movable holding members 5. At this time, the thin workpiece W is not yet held by the fixed holding members 4. In the embodiment, when the thin workpiece W is held by the first movable holding members 5, the end sections at both sides closer to the unwinding roll 2 than the tip of the thin workpiece W are held at the tip side of the thin workpiece W by the first movable holding members 5 by a preset length.

As described above, the thin workpiece W is held by the first movable holding members 5 such that the preset length is maintained. This is because the tip-side end sections at both sides of the thin workpiece W can be held such that the second movable holding members 7 do not interfere with the first movable holding members 5 when the thin workpiece W is delivered to the second movable holding members 7 as will be described below. Therefore, the preset length is set to a length longer than lengths of the lower plates and the upper plates (a length in the conveyance direction of the thin workpiece W) of the second movable holding members 7.

Figure 6:
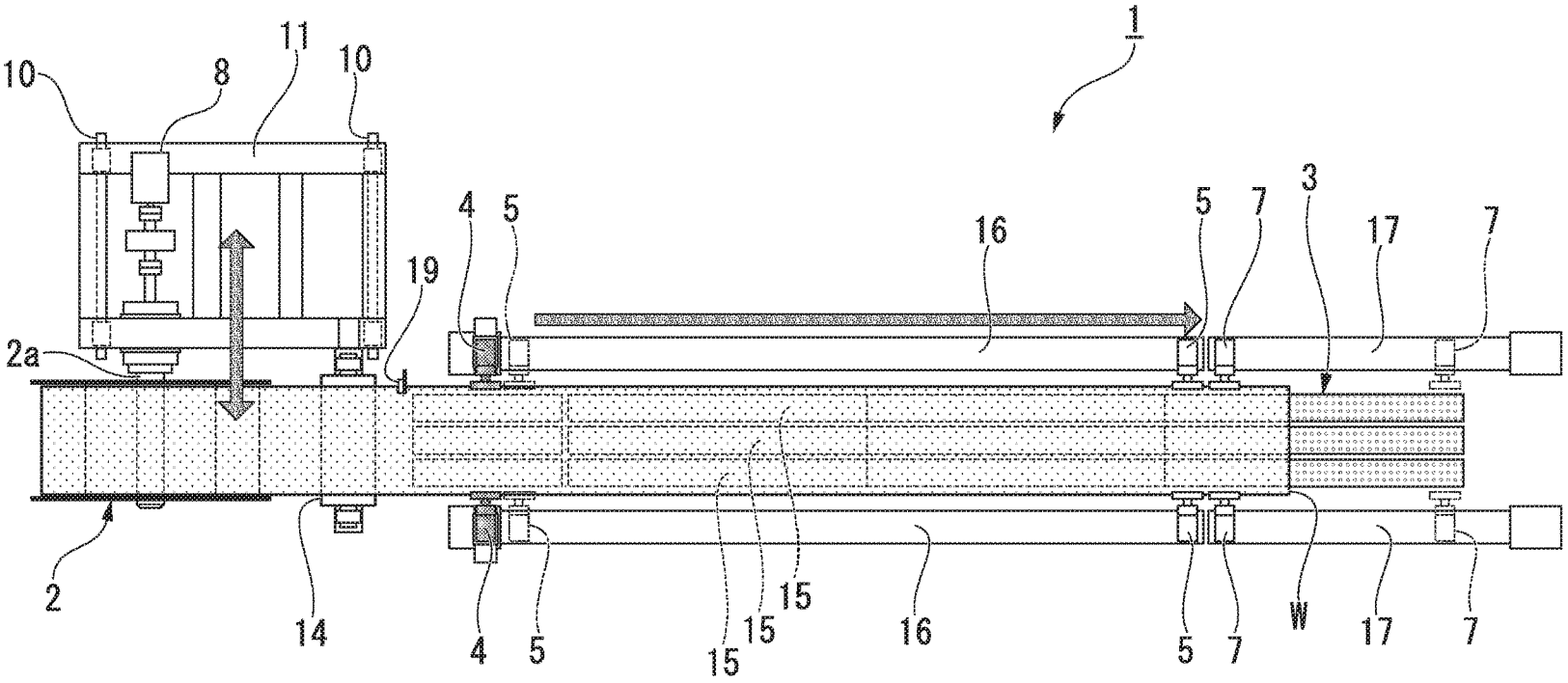
FIG. 6 is a plan view for describing an operation of the conveyor device shown in FIG. 1.

Next, as shown in FIG. 6, the first movable holding members 5 are moved downstream from the conveyance path 3 along the first clamp rails 16, and the thin workpiece W is caused to travel on the conveyance path 3. Thus, a portion of the tip side of the thin workpiece W passes under the cutting device 6. As described above, when the thin workpiece W is caused to travel on the conveyance path 3 by the first movable holding members 5, the first position sensor 19 (refer to FIG. 2) detects the edge position of one side of the thin workpiece W and detects a shift amount from the preset position. Thus, when the thin workpiece W is shifted at the time of the unwinding or the thin workpiece W is meandered and travels on the conveyance path 3 to be shifted in the width direction with respect to the preset position, the shift amount from the preset position can be continuously detected in real time.

In the unwinding position correction mechanism, the control unit continuously controls the unwinding position correction unit 12 based on the detection result of the first position sensor 19 so that position correction in the direction perpendicular to the unwinding direction is performed on the unwinding roll 2 as described above. Thus, the position shift of the thin workpiece W due to meandering, or the like is corrected, and the thin workpiece W straightly moves on the conveyance path 3 as previously set.

As described above, when the first movable holding members 5 are moved downstream from the conveyance path 3 along the first clamp rails 16 and the thin workpiece W is caused to travel on the conveyance path 3 and the first movable holding members 5 reach the preset position, movement of the first movable holding members 5 stops and the travelling of the thin workpiece W stops. Thus, the position correction of the unwinding roll 2, which is continuously performed by the unwinding position correction mechanism, also stops once.

As described above, when the travelling of the thin workpiece W stops and the position correction of the unwinding roll 2, which is continuously performed until then by the unwinding position correction mechanism, also stops, position shifts of the thin workpiece W are continuously corrected so that the thin workpiece W is held in a normal state in which the thin workpiece W does not have position shift with respect to the conveyance path 3. In other words, the thin workpiece W is held in the normal state in which the thin workpiece W is previously set with respect to the cutting device 6. Thus, the end sections at both sides of a side of the unwinding roll 2 of the thin workpiece W in such a normal state are held by the fixed holding members 4.

Also, the tip-side end sections at both sides of the thin workpiece W are also held by the second movable holding members 7 separate from the holding of the thin workpiece W by the fixed holding members 4. In other words, the end sections at both sides closer to the tip side thereof than the end sections at both sides held by the first movable holding members 5 are held by the second movable holding members 7. Subsequently, the thin workpiece W is cut by the cutting device 6 in the width direction thereof. In other words, the thin workpiece W is cut along a cut line 35 indicated by a broken line in FIG. 7.

Figure 8:
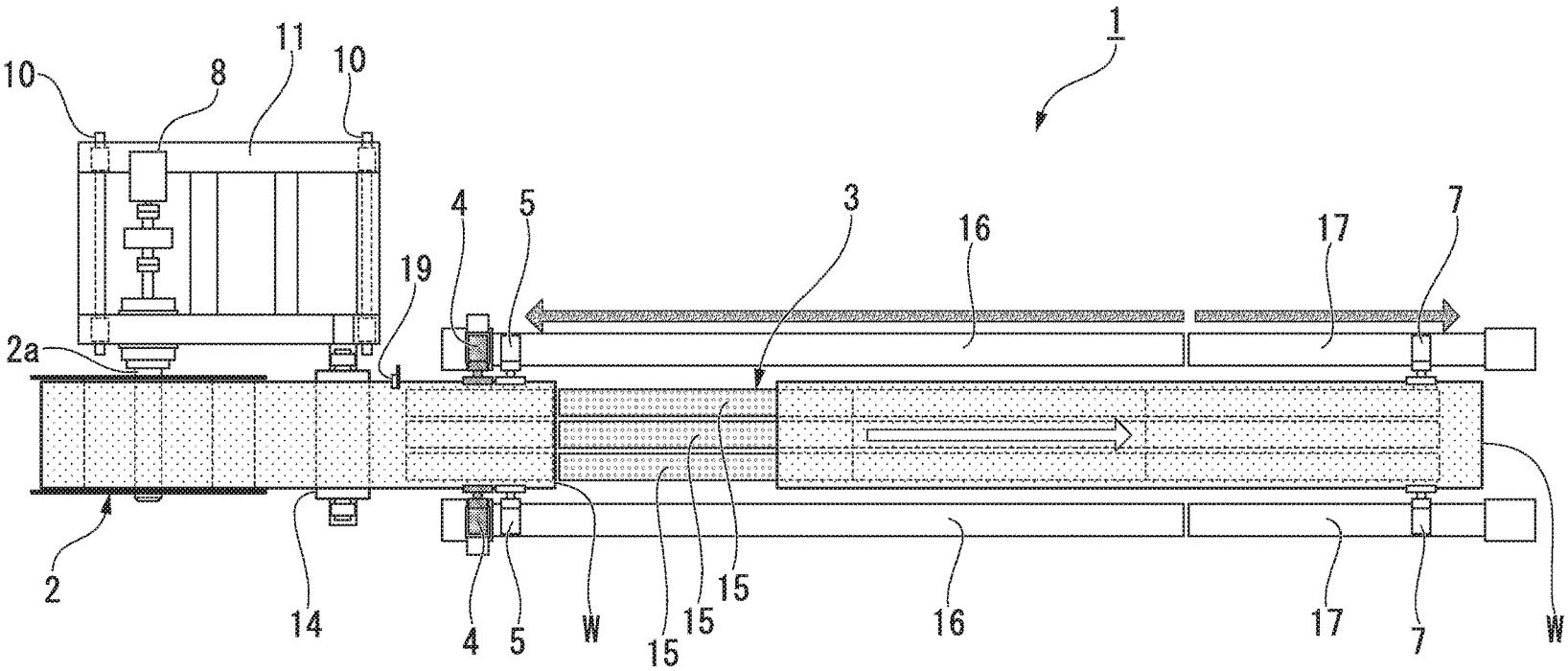
FIG. 8 is a plan view for describing an operation of the conveyor device shown in FIG. 1.

As described above, when the thin workpiece W is cut, the cutting blade of the cutting device 6 is raised, the holding of the cut thin workpiece W by the first movable holding members 5 is released, and the first movable holding members 5 are moved to initial positions of sides of the fixed holding members 4 and hold the tip-side end sections at both sides of the subsequent thin workpiece W held by the fixed holding members 4 as shown in FIG. 8. On the other hand, the second movable holding members 7 are moved toward the downstream side in the conveyance direction so that the cut thin workpiece W is further caused to travel (conveyed) on the conveyance path 3.

When the second movable holding members 7 convey the cut thin workpiece W up to a predetermined position and stop, the transfer device 20 shown in FIG. 2 is moved down and absorptively-holds the thin workpiece W and the holding of the thin workpiece W by the second movable holding members 7 is released. Also, the transfer device 20 is moved, for example, to the lateral side of the conveyance path 3 as indicated by an arrow in FIG. 1, and the thin workpiece W is transferred to the storage section (not shown).

The second movable holding members 7 are moved up to a delivery place of the thin workpiece W shown in FIG. 5 while the cut thin workpiece W is transferred by the transfer device 20 as described above. After that, processes illustrated in FIGS. 5 to 8 are sequentially iterated. In other words, thin workpieces W wound on the unwinding roll 2 are each sequentially unwound, the thin workpiece W is cut at a predetermined dimension, the cut thin workpiece W is conveyed, and the cut thin workpiece W is transferred by the transfer device 20 so that the cut thin workpieces W are sequentially stored in the storage section.

The conveyor device 1 in the embodiment includes the unwinding position correction mechanism configured to correct the position of the unwinding roll 2 in the direction perpendicular to the unwinding direction based on the detection result of the first position sensor 19. Thus, when the thin workpiece W is shifted or meandered at the time of the unwinding, and the thin workpiece W is shifted in the width direction with respect to the preset position, the position shift of the thin workpiece W is detected by the first position sensor 19 so that the position shift of the thin workpiece W can be corrected by the unwinding position correction mechanism configured to correct the position of the unwinding roll 2. Therefore, the thin workpiece W can be accurately cut at a desired dimension by the cutting device 6.

In the conveyor device 1 in the embodiment, the pair of first movable holding members 5 detachably hold the tip-side end sections at both sides of the thin workpiece W, and the pair of second movable holding members 7 detachably hold the end sections at both sides closer to the tip side thereof than the end sections at both sides held by the first movable holding members 5 at the tip side of the thin workpiece W conveyed by the first movable holding members 5. Thus, the thin workpiece W can be substantially conveyed in the noncontact manner by directly holding only the end sections at both sides serving as the non-product quality area without directly holding the product quality area of the thin workpiece W. Therefore, it is possible to prevent the product quality area from being contaminated due to adhesion of foreign substances, or the like.

Figure 9:
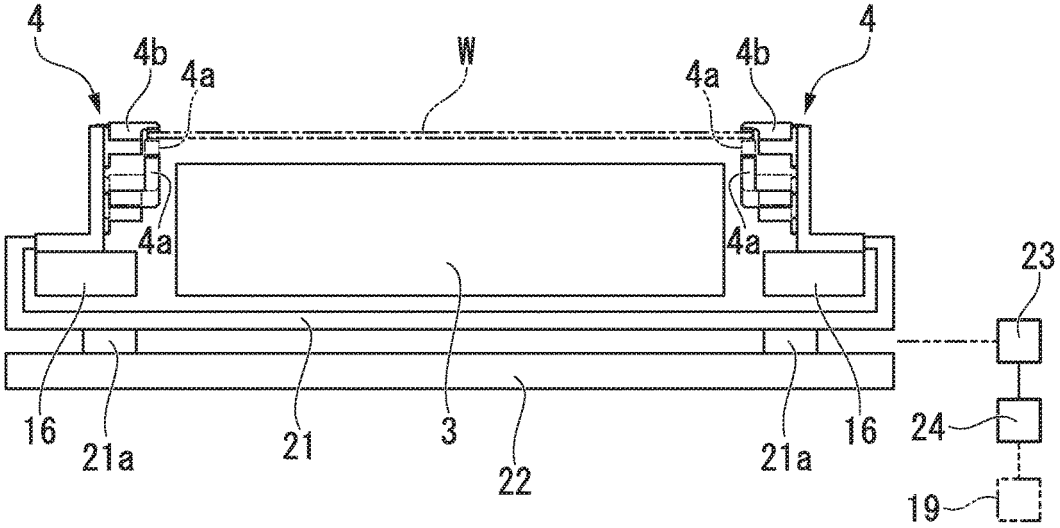
FIG. 9 is a view for describing a fixed holding member and a fixed holding member position correction mechanism related to a second embodiment.

Next, a second embodiment of the conveyor device related to the present disclosure will be described. The conveyor device in the second embodiment is mainly different from the conveyor device 1 in the first embodiment in that the fixed holding members 4 are provided with a fixed holding member position correction mechanism (a second correction mechanism). As shown in FIG. 9, the fixed holding members 4 related to the second embodiment are provided with a U-shaped coupling member 21 connected to rear sides thereof and passing under the conveyance path 3. In other words, the pair of fixed holding members 4 are attached to both end sides of the U-shaped coupling member 21 to be coupled via the coupling member 21.

A pair of travelling sections 21*a* are integrally provided under the coupling member 21. The pair of travelling sections 21*a* are attached to a fixed rail 22 disposed under the conveyance path 3 to be able to reciprocate. The fixed rail 22 is formed to be extended in the direction perpendicular to the conveyance direction of the thin workpiece W, that is, the width direction of the thin workpiece W through the conveyance path 3 and includes a linear motor mechanism and a ball screw mechanism.

Also, the fixed rail 22 or the coupling member 21 is provided with the driving source 23, and the coupling member 21 is caused to accurately reciprocate on the fixed rail 22 according to an operation of the driving source 23. Therefore, the pair of fixed holding members 4 attached to the coupling member 21 and coupled to each other are caused to accurately reciprocate on the fixed rail 22 according to the operation of the driving source 23 while maintaining a distance between each other.

The driving source 23 is provided with a control unit 24, and the control unit 24 is electrically connected to the first position sensor 19. The control unit 24 has the same function as the control unit of the unwinding position correction unit 12 constituting the unwinding position correction mechanism and moves the pair of fixed holding members 4 attached to the coupling member 21 in the direction perpendicular to the conveyance direction of the thin workpiece W (in the width direction of the thin workpiece W) along the fixed rail 22 by operating the driving source 23 based on the detection result of the first position sensor 19. Thus, position correction of the pair of fixed holding members 4 is performed. In other words, the fixed holding member position correction mechanism configured to correct positions of the pair of fixed holding members 4 is constituted by the control unit 24, the driving source 23, the fixed rail 22, the coupling member 21, or the like.

In the embodiment, the control unit of the unwinding position correction unit 12 corrects the position of the unwinding roll 2 in the direction perpendicular to the unwinding direction after the travelling of the thin workpiece W stops and after the thin workpiece W is held by the fixed holding members 4 as well as while the thin workpiece W is caused to travel by the first movable holding members 5.

The conveyor device in the embodiment also operates in substantially the same manner as the conveyor device 1 shown in FIGS. 1 and 2. In other words, as shown in FIG. 5, a thin workpiece W is fed (unwound) from the unwinding roll 2, and tip-side sections at both sides of the thin workpiece W are held by the first movable holding members 5. Next, as shown in FIG. 6, the first movable holding members 5 are moved toward the downstream side of the conveyance path 3 along the first clamp rails 16, and thus the thin workpiece W is caused to travel on the conveyance path 3.

As described above, the first position sensor 19 detects an edge position of one side of the thin workpiece W and detects a shift amount from the preset position when the thin workpiece W is caused to travel on the conveyance path 3 by the first movable holding members 5. Thus, shift amounts in the width direction of the thin workpiece W are each continuously detected in real time. Also, the control unit continuously controls the unwinding position correction unit 12 based on the detection result of the first position sensor 19 so that the unwinding position correction mechanism performs the position correction of the unwinding roll 2 in the direction perpendicular to the unwinding direction. Thus, a position shift of the thin workpiece W due to meandering, or the like is corrected, and the thin workpiece W straightly moves on the conveyance path 3 as previously set.

As described above, when the first movable holding members 5 are moved toward the downstream side of the conveyance path 3 along the first clamp rails 16 and the thin workpiece W is caused to travel on the conveyance path 3 and the first movable holding members 5 reach the preset position, movement of the first movable holding members 5 stops and the travelling of the thin workpiece W stops. Thus, the position correction of the unwinding roll 2, which is continuously performed by the unwinding position correction mechanism, also stops once.

After that, the end sections at both sides of the side of the unwinding roll 2 of the thin workpiece W are held by the fixed holding members 4. Also, the tip-side end sections at both sides of the thin workpiece W are also held by the second movable holding members 7. Subsequently, the position shift of the thin workpiece W held by the fixed holding members 4 is finally corrected before cutting. To be specific, as indicated by arrow B of a chain double dashed line in FIG. 7, the positions of the pair of fixed holding members 4 in the direction perpendicular to the conveyance direction of the thin workpiece W are corrected by the fixed holding member position correction mechanism. Thus, the position shift of the thin workpiece W held by the fixed holding members 4 due to meandering, etc. is finally corrected, and the thin workpiece W is held in a normal state in which it is previously set with respect to the cutting device 6.

In the embodiment, as described above, the position of the unwinding roll 2 in the direction perpendicular to the unwinding direction is also corrected by the unwinding position correction mechanism at the same time as when the position correction of the pair of fixed holding members 4 is performed by the fixed holding member position correction mechanism. Thus, it is possible to prevent torsion of the thin workpiece W from being generated at a portion of a side of the unwinding roll 2 in a portion of the tip side of the thin workpiece W held by the first movable holding members 5.

In other words, when only the pair of fixed holding members 4 are simply moved in the width direction thereof, the unwinding roll 2 is fixed so that torsion is likely to occur at the thin workpiece W. However, as described above, the position correction of the unwinding roll 2 by the unwinding position correction mechanism is also performed simultaneously with the position correction of the fixed holding members 4 by the fixed holding member position correction mechanism so that the torsion of the thin workpiece W can be reliably prevented.

Here, since the fixed holding member position correction mechanism and the unwinding position correction mechanism perform the position corrections based on the same detection result by the first position sensor 19, the fixed holding members 4 and the unwinding roll 2 are basically moved by substantially identical lengths in the same direction. In other words, since sites of the thin workpiece W held by the fixed holding members 4 and sites of the thin workpiece W wound on the unwinding roll 2 are moved in the same direction, torsion does not occur at the tip side of the thin workpiece W, in particular, between the fixed holding members 4 and the unwinding roll 2.

Note that positions of the fixed holding members 4 and a position of the unwinding roll 2 are at different positions in the lengthwise direction of the thin workpiece W. It is preferable to slightly differentiate a position correction amount of the fixed holding members 4 and a position correction amount of the unwinding roll 2 based on a detection value of the first position sensor 19 in consideration of the difference between the positions. A difference between the position correction amount of the fixed holding members 4 and the position correction amount of the unwinding roll 2 is acquired by a pre-calculation, or the like, and the position correction amount of each of the fixed holding member position correction mechanism and the unwinding position correction mechanism is determined based on the calculation formula or the like.

As described above, when the position shift of the thin workpiece W is finally corrected, the thin workpiece W is cut by the cutting device 6 in the width direction thereof. In other words, the thin workpiece W is cut along the cut line 35 indicated by the broken line in FIG. 7.

Subsequently, the cutting blade of the cutting device 6 is raised, the holding of the cut thin workpiece W by the first movable holding members 5 is released, and the first movable holding members 5 are moved to the initial positions of the sides of the fixed holding members 4 and hold the tip-side end sections at both sides of the subsequent thin workpiece W held by the fixed holding members 4 as shown in FIG. 8. On the other hand, the second movable holding members 7 are moved downstream in the conveyance direction so that the cut thin workpiece W is further caused to travel (conveyed) on the conveyance path 3.

Also, when the second movable holding members 7 convey the cut thin workpiece W up to a predetermined position and stop, the transfer device 20 shown in FIG. 2 is moved down and absorption-holds the cut thin workpiece W and the holding of the cut thin workpiece W by the second movable holding members 7 is released. Also, the transfer device 20 is moved, for example, to the lateral side of the conveyance path 3 so that the cut thin workpiece W is moved to the lateral side thereof as indicated by the arrow in FIG. 1. Thus, the cut thin workpiece W is transferred to the storage section (not shown).

In addition, the second movable holding members 7 are moved up to the delivery place of the thin workpiece W shown in FIG. 5 while the cut thin workpiece W is transferred by the transfer device 20 as described above. After that, the processes illustrated in FIGS. 5 to 8 are sequentially iterated so that thin workpieces W wound on the unwinding roll 2 are each sequentially unwound, the thin workpiece W is cut at a predetermined dimension, cut thin workpieces W are each conveyed, and the cut thin workpieces W are sequentially stored in the storage section by transferring the cut thin workpieces W using the transfer device 20.

The conveyor device in the embodiment also includes the unwinding position correction mechanism for correcting the position of the unwinding roll 2 in the direction perpendicular to the unwinding direction based on the detection result of the first position sensor 19. Thus, when the thin workpiece W is shifted or meandered at the time of the unwinding, and thus the thin workpiece W is shifted in the width direction with respect to the preset position, the position shift of the thin workpiece W is detected by the first position sensor 19 so that the position shift of the thin workpiece W can be corrected by the unwinding position correction mechanism configured to correct the position of the unwinding roll 2.

Since the conveyor device in the embodiment includes the fixed holding member position correction mechanism for correcting the positions of the fixed holding members 4 based on the detection result of the first position sensor 19, final position correction can be performed on the thin workpiece W which stops before cutting. Thus, the thin workpiece W can be cut by the cutting device 6 to a desired dimension with higher accuracy.

In the conveyor device in the embodiment, the position of the unwinding roll 2 is corrected by the unwinding position correction mechanism in cooperation with the fixed holding member position correction mechanism when the position of the thin workpiece W is corrected by the fixed holding member position correction mechanism after the fixed holding members 4 hold the thin workpiece W. Thus, torsion can be prevented from occurring at the thin workpiece W.

In the conveyor device in the embodiment, the position of the unwinding roll 2 is corrected by the unwinding position correction mechanism in cooperation with the fixed holding member position correction mechanism when the position of the thin workpiece W is corrected by the fixed holding member position correction mechanism. However, basically, since the position correction of the thin workpiece W is performed by the unwinding position correction mechanism when the thin workpiece W is conveyed by the first movable holding members 5, the position correction amount of the thin workpiece W by the fixed holding member position correction mechanism is small in many cases. Therefore, the position correction of the unwinding roll 2 by the unwinding position correction mechanism in cooperation with the fixed holding member position correction mechanism can be omitted when the position correction amount of the thin workpiece W by the fixed holding member position correction mechanism is small as described above.

Next, a third embodiment of the conveyor device related to the present disclosure will be described. The conveyor device in the third embodiment is mainly different from the conveyor device 1 in the second embodiment in that the first movable holding members 5 is provided with a movable holding member position correction mechanism (a third correction mechanism) instead of the fixed holding members 4 including the fixed holding member position correction mechanism (the second correction mechanism).

Figure 10:
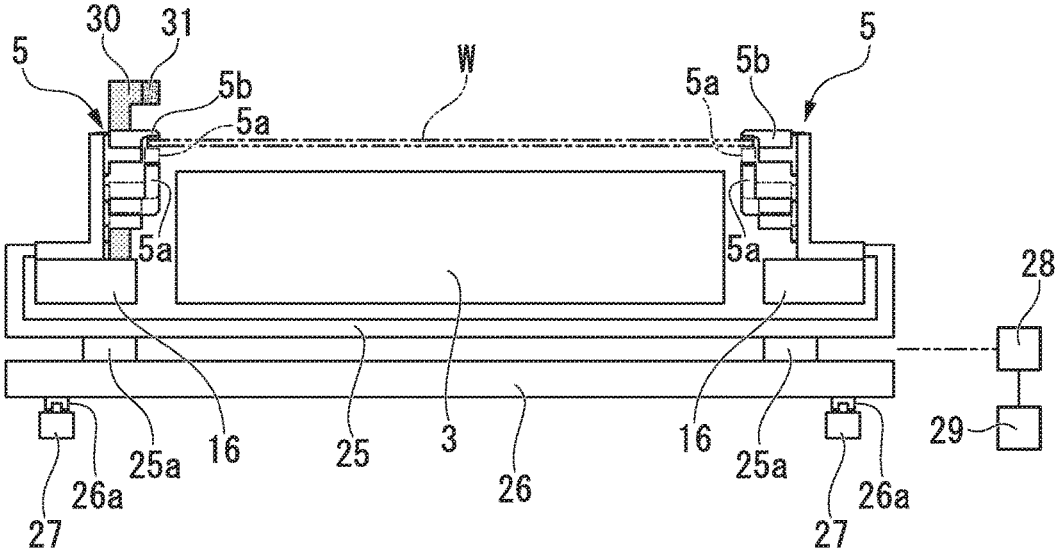
FIG. 10 is a view for describing a first movable holding member and a movable holding member position correction mechanism related to a third embodiment.

As shown in FIG. 10, the first movable holding members 5 related to the third embodiment are provided with a U-shaped coupling member 25 connected to rear sides thereof and passing under the conveyance path 3. In other words, the pair of first movable holding members 5 are attached to both sides of the U-shaped coupling member 25 to be coupled via the coupling member 25.

A pair of travelling sections 25*a* are integrally provided under the coupling member 25. The pair of travelling sections 25*a* are coupled to a moving rail 26 disposed under the conveyance path 3 to be able to reciprocate. The moving rail 26 is formed to be extended in the direction perpendicular to the conveyance direction of the thin workpiece W, that is, the width direction of the thin workpiece W through the conveyance path 3 and includes a linear motor mechanism and a ball screw mechanism.

Also, a pair of travelling sections 26*a* are provided under the moving rail 26, and the pair of travelling sections 26*a* are disposed in the conveyance direction of the thin workpiece W through the conveyance path 3, that is, in parallel with the first clamp rails 16 and are disposed on guide rails 27 fixed to the floor, or the like. With such a constitution, the travelling sections 26*a* can travel in a lengthwise direction of the guide rails 27 and cannot travel in a direction perpendicular to the guide rails 27. Therefore, the moving rail 26 having the travelling sections 26*a* does not move in the direction perpendicular to the guide rails 27 and is fixed.

Also, the moving rail 26 or the coupling member 25 is provided with the driving source 28, and the coupling member 25 is caused to accurately reciprocate on the moving rail 26 according to an operation of the driving source 28. Therefore, the pair of first movable holding members 5 attached to the coupling member 25 and coupled to each other are caused to accurately reciprocate on the moving rail 26 according to the operation of the driving source 28 while maintaining a distance between each other.

The first movable holding members 5 reciprocate on the first clamp rails 16 in the lengthwise direction thereof, that is, the conveyance direction of the conveyance path 3. At this time, as described above, since the travelling sections 26*a* of the moving rail 26 to which the travelling sections 25*a* of the coupling member 25 are coupled can travel on the guide rails 27, the first movable holding members 5 move in the lengthwise direction of the first clamp rails 16, that is, the conveyance direction of the thin workpiece W together with the coupling member 25 and the moving rail 26.

The driving source 28 is provided with a control unit 29, and the control unit 29 is electrically connected to a second position sensor 31 to be described below. Since the control unit 29 has the same function as the control unit 24 constituting the fixed holding member position correction mechanism, the driving source 28 is operated based on a detection result of the second position sensor 31, and the pair of first movable holding members 5 attached to the coupling member 25 are moved in the direction perpendicular to the conveyance direction of the thin workpiece W (in the width direction of the thin workpiece W) along the moving rail 26. Thus, position correction of the pair of first movable holding members 5 is performed. In other words, the movable holding member position correction mechanism (the third correction mechanism) configured to correct the positions of the pair of the first movable holding members is constituted by the control unit 29, the driving source 28, the moving rail 26, the coupling member 25, etc.

In one of the first movable holding members 5, a movable member 30 is provided near the one first movable holding member 5 and closer to the unwinding roll 2 than the corresponding first movable holding member 5 (an upstream side in the conveyance direction of the thin workpiece W). The movable member 30 moves on one of the first clamp rails 16 by being accompanied by the first movable holding member 5 with respect to movement on the first clamp rail 16 of the first movable holding member 5 in the vicinity thereof, but does not move in the width direction of the thin workpiece W without being accompanied by the first movable holding member 5 with respect to movement in the width direction of the thin workpiece W to be described below.

The second position sensor 31 is provided on the upper part of the movable member 30. The second position sensor 31 detects a position in the width direction of the thin workpiece W held by the first movable holding members 5. In other words, the second position sensor 31 detects an edge position of one side of the thin workpiece W like the first position sensor 19 and detects a shift amount, that is, a shift direction and a shift length (a distance) from a preset position.

Also, the second position sensor 31 is electrically connected to the control unit 29 constituting the movable holding member position correction mechanism and transmits a detected shift amount to the control unit 29 as an electrical signal. With such a constitution in the movable holding member position correction mechanism, the control unit 29 operates the driving source 28 and performs position correction of the pair of first movable holding members 5 attached to the coupling member 25 based on a detection result of the second position sensor 31.

The conveyor device in the embodiment also operates in substantially the same manner as the conveyor device 1 illustrated in FIGS. 1 and 2. In other words, as shown in FIG. 5, a thin workpiece W is fed (unwound) from the unwinding roll 2, and tip-side end sections at both sides of the thin workpiece W are held by the first movable holding members 5. Next, as shown in FIG. 6, the first movable holding members 5 are moved toward the downstream side of the conveyance path 3 along the first clamp rails 16, and thus the thin workpiece W is caused to travel on the conveyance path 3.

The first position sensor 19 detects an edge position of one side of the thin workpiece W and detects a shift amount from the preset position when the thin workpiece W is caused to travel on the conveyance path 3 by the first movable holding members 5 as described above. Thus, shift amounts in the width direction of the thin workpiece W are each continuously detected in real time. Also, in the unwinding position correction mechanism, the control unit continuously controls the unwinding position correction unit 12 based on the detection result of the first position sensor 19 to perform the position correction of the unwinding roll 2 in the direction perpendicular to the unwinding direction thereof. Thus, a position shift of the thin workpiece W due to meandering, or the like is corrected, and the thin workpiece W straightly moves on the conveyance path 3 as previously set.

As described above, when the first movable holding members 5 are moved toward the downstream side of the conveyance path 3 along the first clamp rails 16 and the thin workpiece W is caused to travel on the conveyance path 3 and the first movable holding members 5 reach the preset position, movement of the first movable holding members 5 stops and the travelling of the thin workpiece W stops. Thus, the position correction of the unwinding roll 2, which is continuously performed by the unwinding position correction mechanism, also stops once.

After that, the end sections at both sides of the side of the unwinding roll 2 of the thin workpiece W are held by the fixed holding members 4. In the embodiment, as indicated by a chain double dashed line in FIG. 6, the tip-side end sections at both sides of the thin workpiece W are not held by the second movable holding members 7 at this stage. Subsequently, the position shift of the thin workpiece W held by the fixed holding members 4 is finally corrected before cutting. To be specific, as indicated by arrow C of a chain double dashed line in FIG. 7, the positions of the pair of first movable holding members 5 in the direction perpendicular to the conveyance direction of the thin workpiece W are corrected by the movable holding member position correction mechanism.

In other words, an edge position at a slightly upstream side of the tip of the thin workpiece W conveyed while being held by the first movable holding members 5 is detected by the second position sensor 31 fixed in the direction perpendicular to the conveyance direction of the thin workpiece W (the width direction of the thin workpiece W), and a shift amount of the edge position from the preset position is detected. Also, the control unit 29 operates the driving source 28 based on the detection value so that the positions of the first movable holding members 5 in the direction perpendicular to the conveyance direction of the thin workpiece W are corrected as described above. Thus, the position shift of the thin workpiece W held by the first movable holding members 5 and the fixed holding members 4 due to meandering or the like is finally corrected, and the thin workpiece W is held in a normal state in which it is previously set with regard to the cutting device 6.

If the position shift of the thin workpiece W is finally corrected as described above, the thin workpiece W is cut by the cutting device 6 in the width direction thereof. In other words, the thin workpiece W is cut along the cut line 35 indicated by the broken line in FIG. 7.

Figure 7:
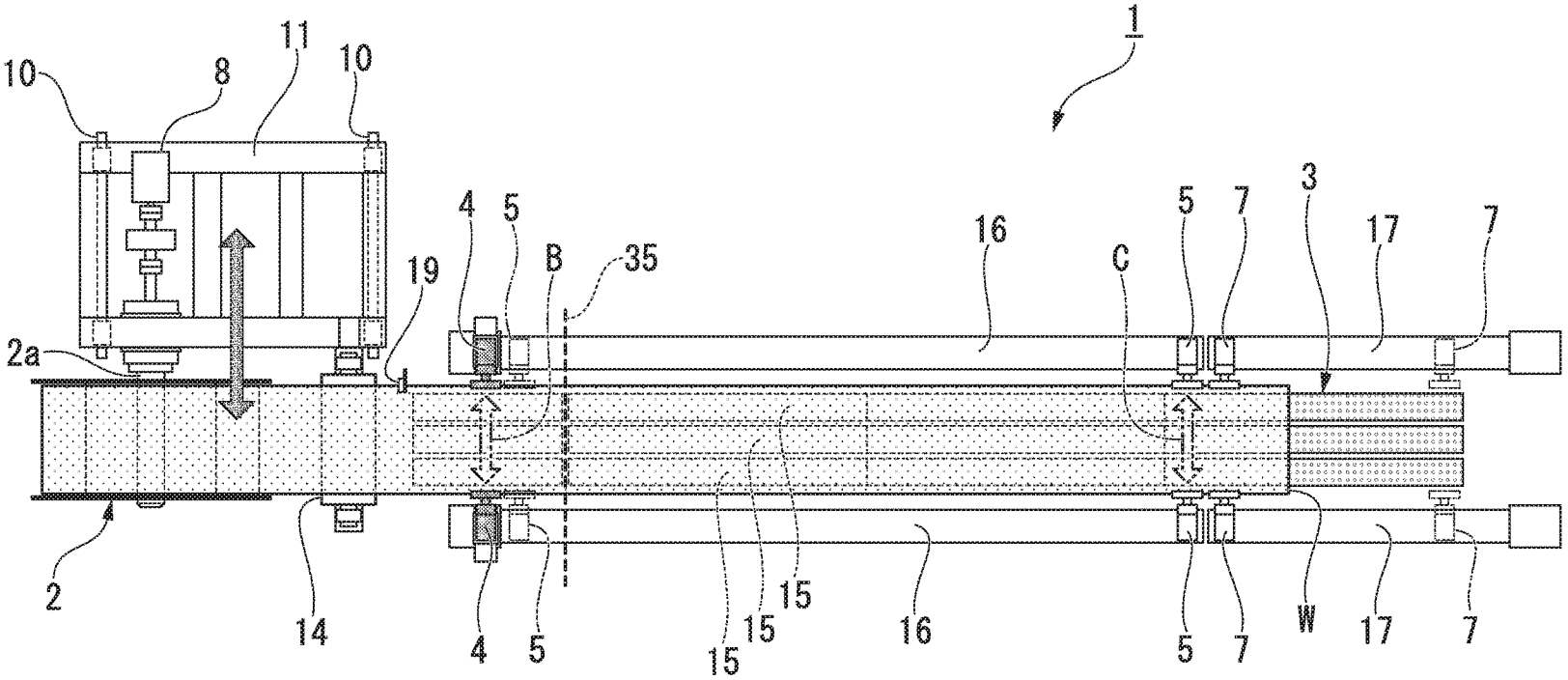
FIG. 7 is a plan view for describing an operation of the conveyor device shown in FIG. 1.

Subsequently, the cutting blade of the cutting device 6 is raised, the tip-side end sections at both sides of the thin workpiece W are held by the second movable holding members 7 indicated by a solid line in FIG. 7. Also, the holding of the cut thin workpiece W by the first movable holding members 5 is released, and the first movable holding members 5 are moved to the initial positions of the sides of the fixed holding members 4 and hold the tip-side end sections at both sides of the subsequent thin workpiece W held by the fixed holding members 4 as shown in FIG. 8. On the other hand, the second movable holding members 7 are moved downstream in the conveyance direction so that the cut thin workpiece W is further caused to travel (conveyed) on the conveyance path 3.

Also, when the second movable holding members 7 conveys the cut thin workpiece W up to a predetermined position and stops, the transfer device 20 shown in FIG. 2 is moved down and absorption-holds the cut thin workpiece W, and the holding of the thin workpiece W by the second movable holding members 7 is released. In addition, the transfer device 20 is moved, for example, to the lateral side of the conveyance path 3 so that the cut thin workpiece W is moved to the lateral side as indicated by the arrow in FIG. 1. Thus, the cut thin workpiece W is transferred to the storage section (not shown).

The second movable holding members 7 are moved to the delivery place of the thin workpiece W shown in FIG. 5 while the cut thin workpiece W is transferred by the transfer device 20 as described above. After that, the processes illustrated in FIGS. 5 to 8 are sequentially iterated so that thin workpieces W wound on the unwinding roll 2 are each sequentially unwound, the thin workpiece W is cut at a predetermined dimension, cut thin workpieces W are each conveyed, and the cut thin workpieces W are sequentially stored in the storage section by transferring the cut thin workpieces W using the transfer device 20.

The conveyor device in the embodiment also includes the unwinding position correction mechanism configured to correct the position of the unwinding roll 2 in the direction perpendicular to the unwinding direction based on the detection result of the first position sensor 19. Thus, when the thin workpiece W is shifted or meandered at the time of the unwinding, and thus the thin workpiece W is shifted in the width direction with respect to the preset position, the position shift of the thin workpiece W is detected by the first position sensor 19 so that the position shift of the thin workpiece W can be corrected by the unwinding position correction mechanism configured to correct the position of the unwinding roll 2.

Also, since the conveyor device in the embodiment includes the movable holding member position correction mechanism configured to correct the positions of the first movable holding members 5 based on the detection result of the second position sensor 31, the final position correction can be performed on the thin workpiece W which stops before cutting. Thus, the thin workpiece W can be cut by the cutting device 6 to a desired dimension with higher accuracy.

Note that the present disclosure is not limited to the embodiments and can be modified in various ways without departing from the scope of the present disclosure. For example, the first position sensor 19 between the unwinding roll 2 and the first movable holding members 5 is not limited to the position shown in FIGS. 1 and 2. The first position sensor 19 can be disposed at any position between the unwinding roll 2 and the first movable holding members 5. Similarly, the second position sensor 31 can also be disposed at any position near the positions of the first movable holding members 5 and closer to the upstream side in the conveyance direction of the thin workpiece W than the first movable holding members 5 when the first movable holding members 5 holds the thin workpiece W to convey it on the conveyance path 3. Also, the fixed holding member position correction mechanism and the movable holding member position correction mechanism are not limited to the structures shown in FIGS. 9 and 10 either but can adopt various structures.

INDUSTRIAL APPLICABILITY

According to the conveyor device of the present disclosure, the unwinding position correction mechanism configured to correct the position of an unwinding roll in a direction perpendicular to an unwinding direction based on a detection result of the first position sensor is provided. Thus, when a thin workpiece is shifted or meandered at the time of the unwinding, and thus the thin workpiece is shifted in a width direction with respect to a preset position, a position shift of the thin workpiece is detected by the first position sensor so that the position shift of the thin workpiece can be corrected by the unwinding position correction mechanism configured to correct the position of the unwinding roll. Therefore, the thin workpiece can be accurately cut by the cutting device at the desired dimension. Also, the tip-side end sections at both sides of the thin workpiece are detachably held by the pair of first movable holding members, and the end sections at both sides closer to the tip side thereof than the end sections at both sides held by the first movable holding members at the tip side of the thin workpiece conveyed through the first movable holding members are detachably held by the pair of second movable holding members. Thus, the thin workpiece can be conveyed in a substantially noncontact manner.

What is claimed is:

1. A conveyor device which feeds a thin workpiece from an unwinding roll and conveys the thin workpiece on a conveyance path, the conveyor device comprising:

a pair of first movable holding members configured to detachably hold tip-side end sections at both sides of the thin workpiece fed on the conveyance path and convey the thin workpiece on the conveyance path;

a pair of fixed holding members configured to detachably hold end sections at both sides of a side of the unwinding roll of the thin workpiece fed on the conveyance path;

a cutting device configured to cut the thin workpiece in a width direction thereof between the first movable holding members and the fixed holding members;

a pair of second movable holding members configured to detachably hold end sections at both sides closer to a tip side of the thin workpiece conveyed by the first movable holding members than the end sections at both sides held by the first movable holding member at the tip side thereof and further convey the thin workpiece on the conveyance path;

a first position sensor provided between the unwinding roll and the first movable holding members and configured to detect a position in the width direction of the thin workpiece fed from the unwinding roll;

a first correction mechanism configured to correct a position of the unwinding roll in a direction perpendicular to an unwinding direction based on a detection result of the first position sensor; and a second correction mechanism configured to correct positions of the fixed holding members holding the thin workpiece in a direction perpendicular to a conveyance direction of the thin workpiece based on the detection result of the first position sensor.

2. The conveyor device according to claim 1, wherein the first correction mechanism corrects a position of the unwinding roll in a direction perpendicular to the unwinding direction in cooperation with the second correction mechanism when the positions of the fixed holding members holding the thin workpiece in the direction perpendicular to the conveyance direction of the thin workpiece are corrected by the second correction mechanism.

* * * * *